US009461388B2

(12) United States Patent
Zhao et al.

(10) Patent No.: US 9,461,388 B2
(45) Date of Patent: Oct. 4, 2016

(54) ELECTRICAL CONNECTOR HAVING IMPROVED TONGUE PORTION

(71) Applicant: HON HAI PRECISION INDUSTRY CO., LTD., New Taipei (TW)

(72) Inventors: Jun Zhao, Kunshan (CN); Jing-Jie Guo, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/291,428

(22) Filed: May 30, 2014

(65) Prior Publication Data

US 2014/0357124 A1 Dec. 4, 2014

(30) Foreign Application Priority Data

May 31, 2013 (CN) ..... 2013 2 0309845
Jun. 3, 2013 (CN) ..... 2013 2 0312503
Jun. 13, 2013 (CN) ..... 2013 2 0312504

(51) Int. Cl.

*H01R 13/405* (2006.01)
*H01R 13/6581* (2011.01)
*H01R 13/6596* (2011.01)
*H01R 12/72* (2011.01)
*H01R 13/6594* (2011.01)
*H01R 13/6593* (2011.01)

(52) U.S. Cl.

CPC ..... *H01R 13/405* (2013.01); *H01R 13/6581* (2013.01); *H01R 13/6596* (2013.01); *H01R 12/724* (2013.01); *H01R 13/6593* (2013.01); *H01R 13/6594* (2013.01)

(58) Field of Classification Search

CPC ..... H01R 13/65802; H01R 13/6581; H01R 13/6593; H01R 13/6594; H01R 12/724
USPC ..... 439/607.58, 607.55, 607.35, 660
See application file for complete search history.

(56) References Cited

U.S. PATENT DOCUMENTS 7,112,087 B2 9/2006 Tago et al.
8,052,477 B1 * 11/2011 Ko ..... H01R 27/00 439/660
8,657,633 B2 2/2014 Shindo et al.

(Continued)

FOREIGN PATENT DOCUMENTS

CN 201904481 7/2011
CN 201904481 U * 7/2011
CN 201220459789.3 * 9/2012 ..... H01R 13/516

(Continued)

*Primary Examiner* — Abdullah Riyami
*Assistant Examiner* — Justin Kratt
(74) *Attorney, Agent, or Firm* — Ming Chieh Chang; Wei Te Chung

(57) ABSTRACT

An electrical connector (100) includes an insulative housing (1), a number of terminals (2) mounted to the housing and including a pair of outermost terminals, and a stiffener (3) attached to the housing and defining a pair of openings. The insulative housing includes a tongue portion (12) defining a number of passageways (121), a pair of first indentations (123) each opened upwardly and extending through an upper portion and a side portion of the tongue portion. The outermost terminal (20) has an upper surface and a side surface partly exposed outwardly via the first indentation and the opening. Also disclosed is a compression mounted electrical connector including a shell and a grounding member secured to the shell and similarly configured as terminals thereof.

16 Claims, 10 Drawing Sheets

(56) References Cited

U.S. PATENT DOCUMENTS

| | | | | |
|---|---|---|---|---|
| 2014/0065889 | A1* | 3/2014 | Zhang | H01R 43/24 439/660 |
| 2014/0073190 | A1* | 3/2014 | Zhao et al. | 439/626 |

FOREIGN PATENT DOCUMENTS

| | | |
|---|---|---|
| CN | 201656023 | 11/2014 |
| TW | M385114 | 7/2010 |

* cited by examiner

ELECTRICAL CONNECTOR HAVING IMPROVED TONGUE PORTION

BACKGROUND OF THE INVENTION

1. Field of the Invention

The present invention relates to an electrical connector, and more particularly to a micro USB (Universal Serial Bus) connector that positions its terminals precisely for preventing short circuit or fire breakout. The present invention also relates to a compression mount electrical connector including a shell and a specially designed grounding member secured to the shell and similarly configured as terminals thereof.

2. Description of Related Art

China Utility Patent No. 201904481 issued on Jul. 20, 2011 discloses a micro USB connector including an insulative housing having a base portion and a tongue portion extending from the base portion, a plurality of contacts affixed to the insulative housing, a stiffener having a pair of side portions attached to the tongue portion, and a shell shielding the insulative housing. The tongue portion defines a plurality of channels on a lower surface thereof for receiving the contacts and a plurality of holes on an upper surface thereof for positioning modules. The two outermost terminals neighboring side portions of the stiffener, if not properly positioned during manufacturing, may be too close to the metal stiffener as to cause short circuit or fire breakout.

U.S. Publication No. 2014/0065889, published on Mar. 6, 2014, discloses a micro USB connector including an insulative housing having a base portion and a tongue portion, and a plurality of terminals. The tongue portion has a plurality of ribs on a lower surface thereof and a plurality of passageways alternating with the ribs. Each rib has an indentation opened downwardly accommodating a mold. The indentation is defined at the lower surface of the tongue portion such that it is not feasible to provide a stiffener at an upper portion of the tongue portion because the mold may not be used for positioning the stiffener through the indentation.

A micro USB connector having an improved tongue portion is desired.

SUMMARY OF THE INVENTION

Accordingly, an object of the present invention is to provide an electrical connector comprising: an insulative housing including a base portion and a tongue portion extending forwardly from the base portion, said tongue portion having an upper portion, a lower portion, a pair of side portions, and a plurality of passageways at the lower portion, said tongue portion defining a pair of first indentations each exposing upwardly and through the upper portion and the side portion for accommodating a first mold; a plurality of terminals including a pair of outermost terminals, each terminal having a body portion secured in the passageway of the insulative housing; and a stiffener attached to the upper portion of the tongue portion and defining a pair of openings aligned with the first indentations respectively, said body portion of each outermost terminal having an upper surface and a side surface for being resisted against by the first mold, the upper surface and the side surface of the outermost terminal body portion partly exposed outwardly via the first indentation and the opening after removal of the first mold.

The terminals and the stiffener may be confined at predetermined positions precisely by the first mold through the first indentation. The outermost terminal is resisted to keep a certain distance away from a side wall of the stiffener by the first mold. Therefore, short circuit or fire breaking out caused by the outermost terminal and the stiffener is prevented.

Another object of the present invention is to provide an electrical connector comprising: an insulative housing including a base portion and a tongue portion extending forwardly from the base portion; a plurality of terminals each having a contact portion, a body portion secured in the tongue portion, a substantially V-shaped compressible tail portion, and a connecting portion between the tail portion and the body portion, said tail portion disposed below the insulative housing and facing to the body portion for compression mount to a printed circuit board; a shell including a top wall, a bottom wall, and a pair of side walls and shielding the insulative housing; and a grounding member comprising a primary plate secured to the bottom wall of the shell and a pair of resisting portions disposed at two opposite sides of the primary plate, each resisting portion having a configuration substantially same to that of the tail portion for being compression mount to the printed circuit board.

Other objects, advantages and novel features of the invention will become more apparent from the following detailed description when taken in conjunction with the accompanying drawings.

DETAILED DESCRIPTION OF THE PREFERRED EMBODIMENT

Figure 1:
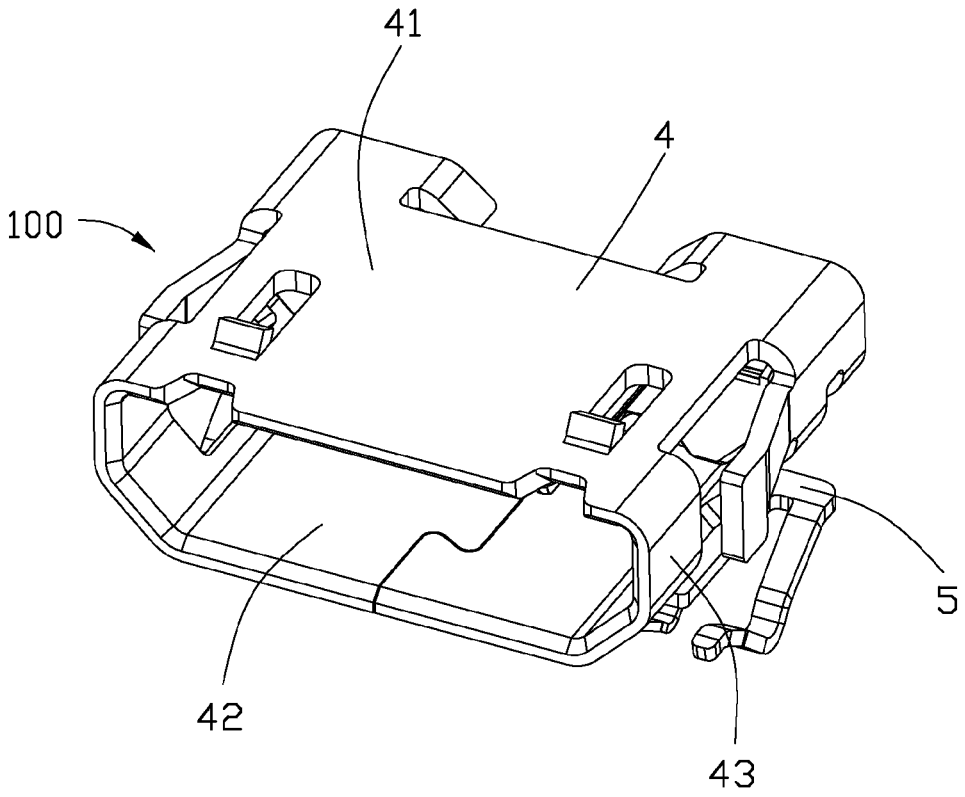
FIG. 1 is an assembled perspective view showing an electrical connector in accordance with a first embodiment of the present invention.
Figure 2:
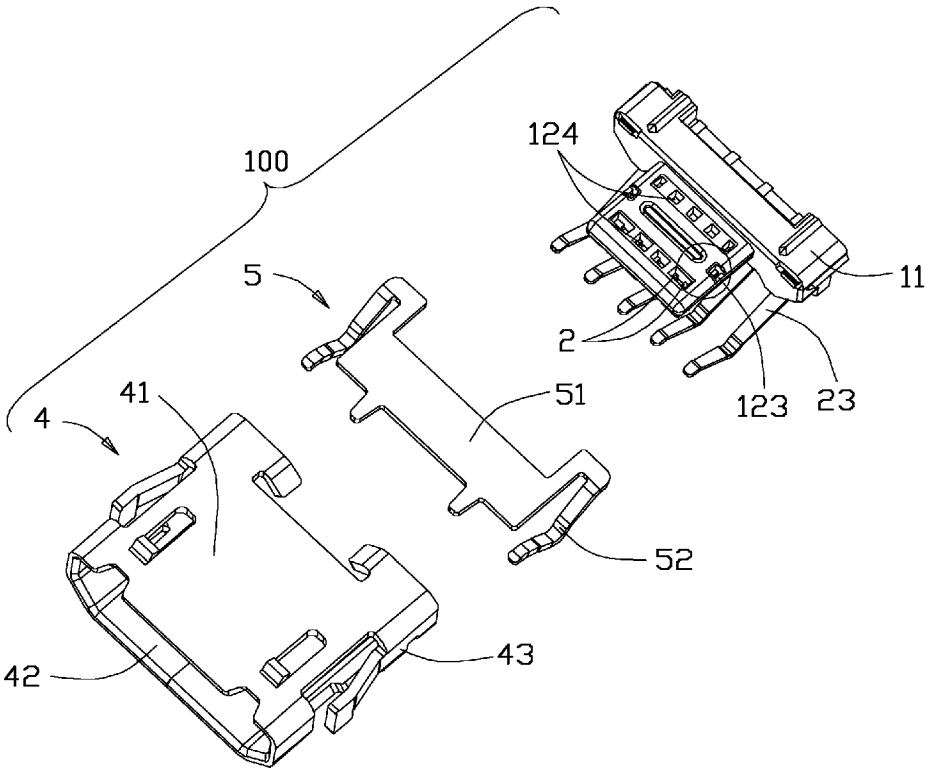
FIG. 2 is a partly exploded perspective view showing the electrical connector shown in FIG. 1, with a stiffener attached to an insulative housing together with terminals.

Reference will now be made in detail to the preferred embodiment of the present invention. Referring to FIGS. 1-6, an electrical connector 100 in a first embodiment comprises an insulative housing 1 including a base portion 11 and a tongue portion 12 extending forwardly from the base portion 11, a plurality of terminals 2 integrated with the insulative housing 1 in an insert molding process, a stiffener 3 attached to the tongue portion 12, a shell 4 shielding the insulative housing 1 and a grounding member 5 attached to the shell 4.

Figure 3:
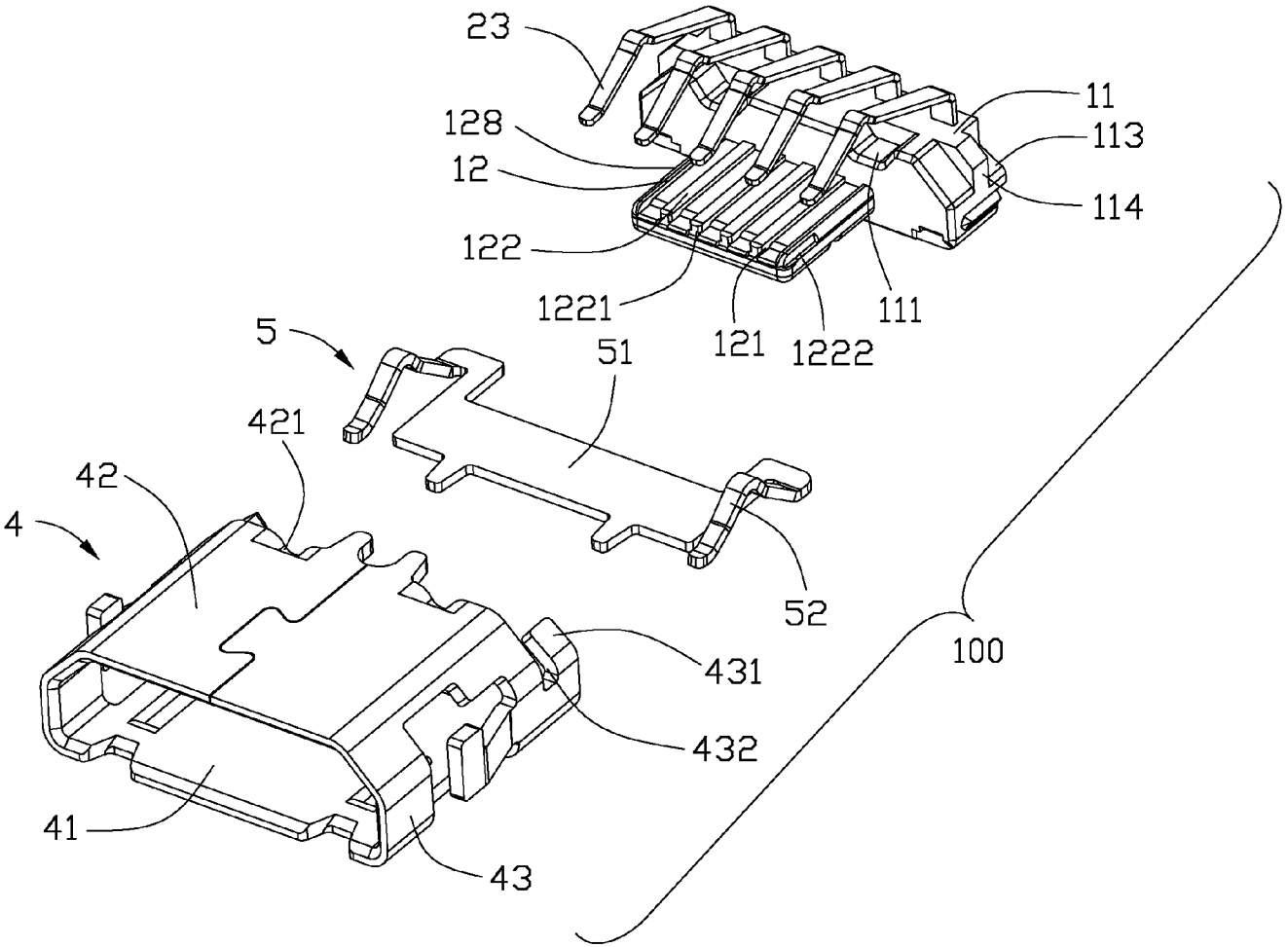
FIG. 3 is another partly exploded view similar to FIG. 2, taken from another aspect.

Referring to FIG. 3, the base portion 11 defines a pair of cutouts 111 at a lower side thereof, a pair of protrusions 114 formed at opposite sides thereof, and a concave 113 behind each protrusion 114.

Figure 4:
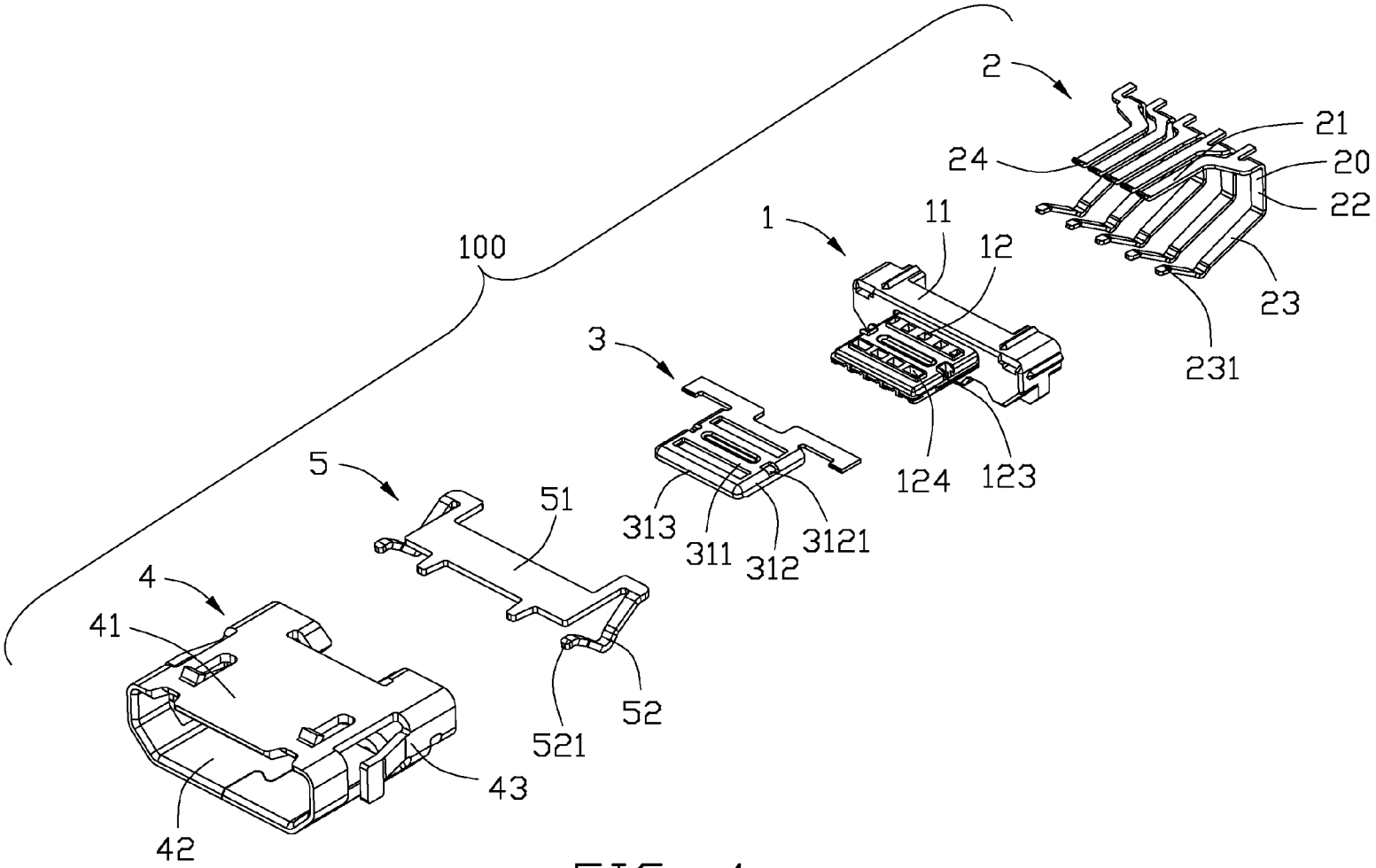
FIG. 4 is an exploded view showing the electrical connector shown in FIG. 2.
Figure 5:
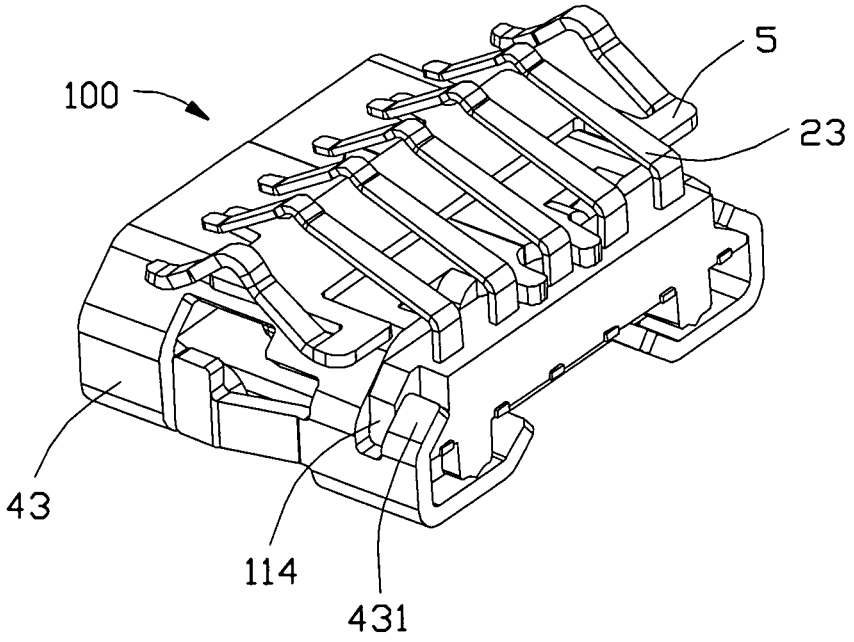
FIG. 5 is another assembled view similar to FIG. 1, taken from another aspect.

Referring to FIGS. 3 and 4, the tongue portion 12 has an upper portion, a lower portion, a pair of side portions, a pair of flanges 128 formed at opposite sides of the lower portion, a plurality of passageways 121 defined between the pair of flanges 128, and a plurality of ribs 122 alternating with the plurality of passageways 121.

Figure 7:
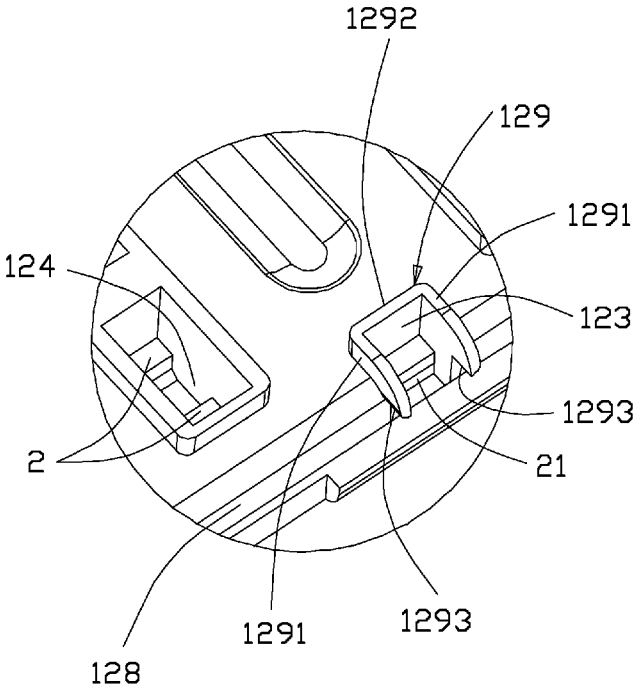
FIG. 7 is an enlarged view showing a part of the tongue portion marked in FIG. 6.

In conjunction with FIG. 7, the tongue portion 12 defines a first indentation 123 opened upwardly and extending through the upper portion and the side portion of the tongue portion 12 accommodating a first mold (not shown) which is used to resist against the terminals 2 in the insert molding process. The upper portion of tongue portion 12 defines a plurality of second indentations 124 staggered with the passageways 121 communicating with a plurality of substantially T-shaped second molds (not shown) which are used to resist against the terminals 2 in the insert molding process. Each flange 128 defines a first recess 1222 accommodating a fourth mold (not shown) confining the terminals 2 in the insert molding process. Each rib 122 has a front end retreated backwardly to form a second recess 1221 accommodating a fifth mold (not shown) confining the terminals 2 in the insert molding process.

In conjunction with FIG. 4, the plurality of terminals 2 include a pair of outermost terminals 20. Each terminal 2 includes a horizontal body portion 21, a contacting portion 24 formed at a front end of the body portion 21, a substantially V-shaped compressible tail portion 23 and a substantially vertical connecting portion 22 connecting with the tail portion 23 and the body portion 21. Each tail portion 23 has an end portion 231 formed at a free end thereof.

Figure 6:
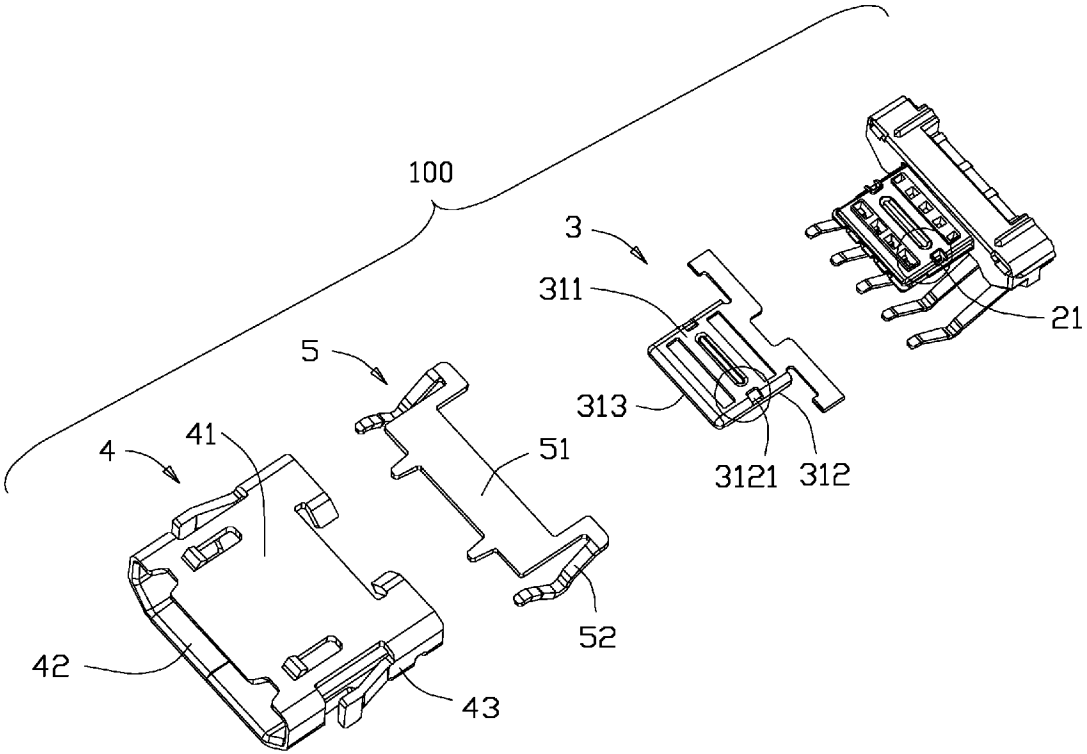
FIG. 6 is a partly exploded view showing the electrical connector, with the terminals integrated to the insulative housing.

Referring to FIGS. 4 and 6, the stiffener 3 includes a top wall 311, a front wall 313 and a pair of side walls 312 shielding the tongue portion 12. The stiffener 3 defines an opening 3121 extending through the top wall 311 and the side wall 312 for aligning with the first indentation 123.

In conjunction with FIG. 3, the shell 4 is substantially case-shaped and includes a top wall 41, a bottom wall 42 and a pair of side walls 43. The bottom wall 42 includes a pair of arms 421 projecting upwardly. Each side wall 43 has a latching portion 431 and a latching slot 432 in front of the latching portion 431.

The grounding member 5 comprises a primary plate 51 and a pair of resisting portions 52 disposed at opposite sides of the primary plate 51 for being pressed against onto a printed circuit board. Each resisting portion 52 has a configuration substantially same to that of the tail portion 23 for being pressed against onto the printed circuit board. Each resisting portions 52 has an end portion 521 formed at a free end thereof.

Figure 7A:
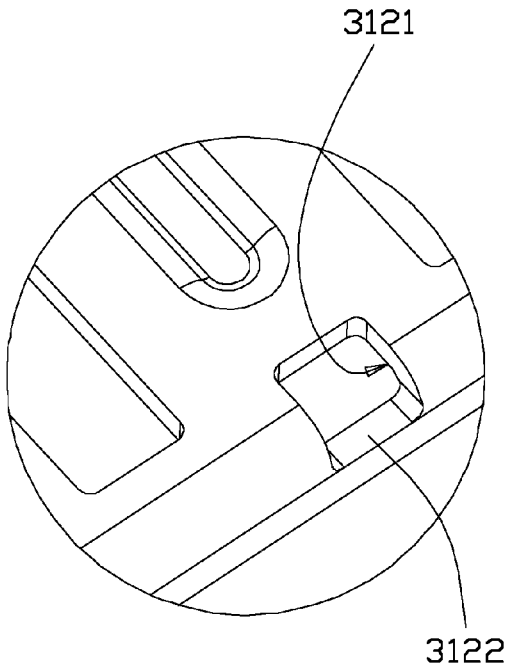
FIG. 7(A) is an enlarged view showing a part of the stiffener marked in FIG. 6.
Figure 7B:
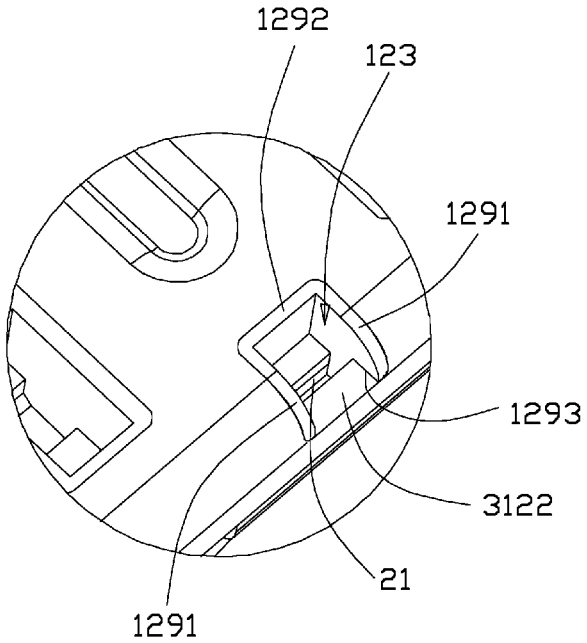
FIG. 7(B) is an enlarged view showing a part of the assembled tongue portion and stiffener marked in FIG. 2.

Referring to FIGS. 1-7, in assembling of the electrical connector 100, the terminals 2 are secured in the passageways 121 of the insulative housing 1 and the stiffener 3 is attached to the upper portion of the tongue portion 12 by insert molding. The openings 3121 are respectively aligned with the first indentations 123. The upper surface and the side surface of the body portion 21 of each outermost terminals 20 are resisted against by the first mold. The upper surfaces and side surfaces of the terminals 2 are resisted against by the second molds. The body portion 21 of each outermost terminal 20 is partly exposed outwardly via the first indentation 123 and the opening 3121 after the removal of the first mold. Two adjacent terminals 2 are exposed outwardly via one corresponding second indentation 124 after the removal of the second mold. The tail portions 23 are disposed below the insulative housing 1 and facing to the body portions 21 for compression mount to a printed circuit board. In details, as showed in the enlarged FIGS. 7, 7(A) and 7(B), the flange 128 forms a protrusion 129 around the corresponding indentation 123, and the protrusion 129 forms a U-shaped structure with a pair of legs 1291 spaced from each other with a transverse bar 1292 linked therebetween. The protrusion 129 is received within the corresponding opening 3121. A pair of downward abutment sections 1293 are respectively formed at the ends of the corresponding legs 1291 to commonly abut downwardly against an upward abutment section 3122 of the stiffener 3 around the corresponding opening 3121.

The insulative housing 1 together with the terminals 2 and the stiffener 3 is enclosed in the shell 4, with the pair of arms 421 received in the cutouts 111. The protrusions 114 latches with the latching slots 432. The latching portions 431 engage with the concaves 113. The primary plate 51 of the grounding member 5 is welded onto the bottom wall 42 of the shell 4. In one exemplary use, the connector 100 together with a face plate is mounted through an opening of an electronic device to connect with an internal printed circuit board. In such use, since the end portions 231 of the terminals 2 and the end portions 521 of the grounding member 5, each shaped as one leg of a substantially V-shaped configuration, press upon the face plate and thus cross over a peripheral wall of the opening, the electrical connector 100 can be readily removed from the electronic device without obstruction of the terminals 2 and/or the grounding member 5.

Figure 8:
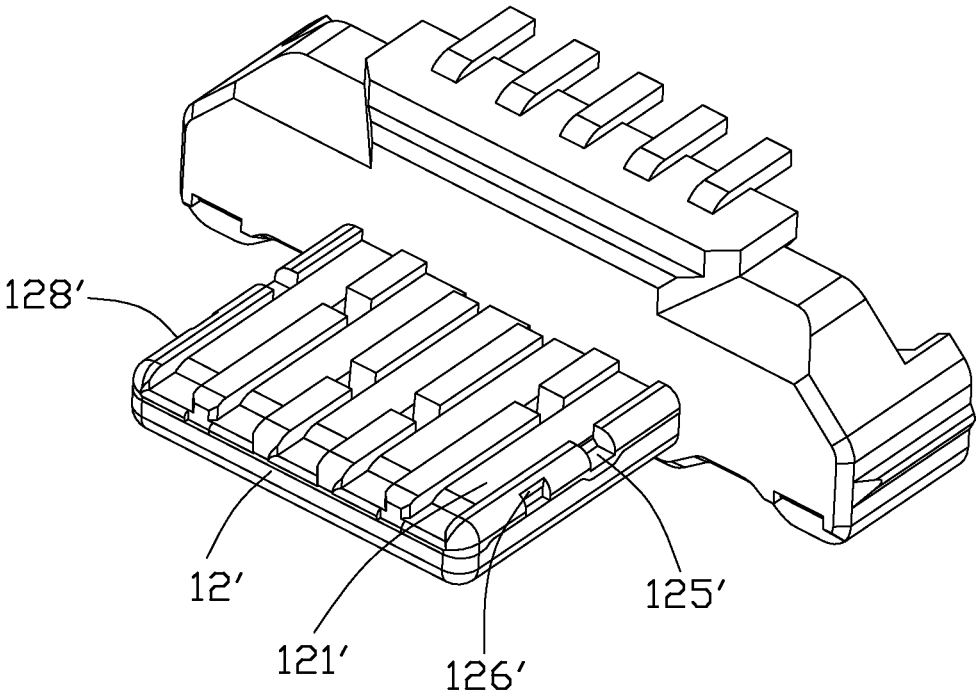
FIG. 8 is a perspective view showing an insulative housing referred in a second embodiment of the present invention.

Referring to FIG. 8, in a second embodiment, the flange 128' defines a third indentation 125' exposing through the lower surface and the side portion of tongue portion 12' and communicating with the adjacent passageway 121' for accommodating a third mold (not shown). The lower surface and the side surface of the body portion 21 of each outermost terminal 20 are resisted against by the third mold, and exposed outwardly via the third indentation 125' after removal of the third mold. The flange 128' defines a fourth indentation 126' exposing through the upper portion, the side portion, and the lower portion of the tongue portion 12' and communicating with adjacent passageway 121' for accommodating a fourth mold (not shown) to confine the stiffener 3. The third and fourth indentations 125' and 126' may coexist with the first indentation 123 or be formed alone.

The terminals 2 and the stiffener 3 could be confined at predetermined positions precisely by the first to fourth molds, i.e., through the first to fourth indentations 123, 124, 125', 126'. Especially, the outermost terminals 20 are resisted to keep a certain distance away from the side walls 312 of the stiffener 3 by the first mold. Therefore, potential short circuit or fire breaking out caused by close proximity between the outermost terminals 20 and the stiffener 3 is prevented. Additionally, the outermost terminals 20 are separated from the side walls 312 of the stiffener 3 by the flanges 128, and resisted against by the third molds from approaching the side walls 312 of the stiffener 3. Therefore, short circuit or fire breaking out caused by the outermost terminals 20 and the stiffener 3 is further prevented.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a base portion and a tongue portion extending forwardly from the base portion, said tongue portion having an upper portion, a lower portion, a pair of side portions, and a plurality of passageways at the lower portion, said tongue portion defining a pair of first indentations each exposing upwardly and through the upper portion and the side portion;

a plurality of terminals including a pair of outermost terminals, each terminal having a body portion secured in the passageways of the insulative housing, a substantially V-shaped compressible tail portion, and a connecting portion connecting with the tail portion and the body portion, said tail portion disposed below the insulative housing and facing the body portions for compression mounting to a printed circuit board; and a stiffener attached to the upper portion of the tongue portion and defining a pair of openings aligning with the first indentations respectively, said body portion of each outermost terminal having a side surface partly exposed outwardly via the first indentation and the opening.

2. The electrical connector as claimed in claim 1, wherein said stiffener includes a top wall shielding the upper portion of the tongue portion and a pair of side walls shielding the pair of side portions of the tongue portion, each opening extending through the top wall and the side wall of the stiffener.

3. The electrical connector as claimed in claim 1, wherein said lower portion of the tongue portion includes a plurality of ribs alternating with the plurality of passageways, said rib having a front end retreated backwardly to form a first recess.

4. The electrical connector as claimed in claim 1, wherein said upper portion of tongue portion defines a plurality of second indentations staggered with the passageways, each of the body portions of the terminals having an upper surface and a side surface, the upper and side surfaces of every two adjacent terminals partly exposed outwardly via one corresponding second indentation.

5. The electrical connector as claimed in claim 4, wherein said tongue portion has a pair of flanges at two opposite sides of the lower portion, said plurality of passageways defined between the pair of flanges.

6. The electrical connector as claimed in claim 5, wherein said flange defines a third indentation opened downwardly and extending through the side portion of the tongue portion, said body portion of each outermost terminal having a lower surface, the lower surface and the side surface of the outermost terminal body portion exposed outwardly.

7. The electrical connector as claimed in claim 6, wherein said flange defines a fourth indentation exposing through the upper portion, the side portion, and the lower portion of the tongue portion.

8. The electrical connector as claimed in claim 1, further comprising a shell and a grounding member attached to the shell, the shell including a top wall, a bottom wall, and a pair of side walls and shielding the insulative housing.

9. The electrical connector as claimed in claim 8, wherein said grounding member comprises a primary plate welded onto the bottom wall of the shell and a pair of resisting portions disposed at two opposite sides of the primary plate, each resisting portion having a configuration substantially the same as that of the tail portion for being compression mounted to the printed circuit board.

10. The electrical connector as claimed in claim 9, wherein each of the resisting portion and the tail portion comprises an end portion proximate to a bottom wall of the shell.

11. An electrical connector comprising:

an insulative housing including a base portion and a tongue portion extending forwardly from the base portion;

a plurality of terminals each having a contact portion, a body portion secured in the tongue portion, a substantially V-shaped compressible tail portion, and a connecting portion between the tail portion and the body portion, said tail portion disposed below the insulative housing and facing to the body portion for compression mounting to a printed circuit board;

a shell including a top wall, a bottom wall and a pair of side walls and shielding the insulative housing; and a grounding member comprising a primary plate secured to the bottom wall of the shell and a pair of resisting portions disposed at opposite sides of the primary plate, each resisting portion having a configuration substantially the same as that of the tail portion for being compression mounted to the printed circuit board.

12. The electrical connector as claimed in claim 11, wherein each of the resisting portion and the tail portion comprises an end portion proximate to a bottom wall of the shell.

13. An electrical connector comprising:

an insulative housing including a base portion and a tongue portion extending forwardly from the base portion, said tongue portion having an upper portion, a lower portion, a pair of side portions, and a plurality of passageways at the lower portion, said tongue portion further defining a plurality of indentations each exposing upwardly and through the upper portion in a vertical direction and alternating with said passageways along a transverse direction perpendicular to said vertical direction;

a plurality of terminals each having a body portion secured in the corresponding passageway of the insulative housing; wherein the body portion of each of the terminals forms an upper surface and a side surface, and the upper surfaces and the side surfaces of every adjacent two terminals are partly exposed to an exterior via one corresponding indentation which is located between said adjacent two terminals; wherein said tongue portion has a pair of flanges at two opposite sides of the lower portion, and said plurality of passageways are defined between the pair of flanges; wherein each of said flanges defines another indentation opened downwardly and extending into the side portion of the tongue portion to expose the body portion of an outermost terminal;

further including a metallic stiffener attached upon the upper portion of the tongue portion, wherein each of said another indentations is exposed, through a corresponding opening of said stiffener, upwardly to said exterior; wherein each of said flanges defines a protrusion, which is formed around said corresponding another indentation and defines a U-shaped structure received and surrounded within the corresponding opening in a top view; wherein said U-shaped structure includes a pair of legs spaced from each other with a transverse bar linked therebetween; wherein a pair of downward abutment sections are respectively formed at corresponding ends of said pair of legs to commonly abut downwardly against an upward abutment section of the metallic stiffener, wherein said upward abutment section is formed around the corresponding opening of said metallic stiffener.

14. The electrical connector as claimed in claim 13, further comprising a shell and a grounding member attached to the shell, the shell including a top wall, a bottom wall, and a pair of side walls to shield the insulative housing.

15. The electrical connector as claimed in claim 14, wherein each terminal comprises a substantially V-shaped compressible tail portion and a connecting portion connecting with the tail portion and the body portion, said tail portion disposed below the insulative housing and facing to the body portions for compression mount to a printed circuit board.

16. The electrical connector as claimed in claim 15, wherein said grounding member comprises a primary plate welded onto the bottom wall of the shell and a pair of resisting portions disposed at two opposite sides of the primary plate, each resisting portion having a configuration substantially same as that of the tail portion for being compression mounted to the printed circuit board.

* * * * *